US009095852B2

(12) United States Patent
Lee et al.

(10) Patent No.: US 9,095,852 B2
(45) Date of Patent: Aug. 4, 2015

(54) MULTILAYER HIGH DENSITY MICROWELLS

(75) Inventors: Abraham P. Lee, Irvine, CA (US); Andrew C. Hatch, Queen Creek, AZ (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 0 days.

(21) Appl. No.: 13/592,071

(22) Filed: Aug. 22, 2012

(65) Prior Publication Data

US 2013/0052649 A1 Feb. 28, 2013

Related U.S. Application Data

(60) Provisional application No. 61/525,976, filed on Aug. 22, 2011.

(51) Int. Cl.
*B01L 3/00* (2006.01)

(52) U.S. Cl.
CPC ..... *B01L 3/5085* (2013.01); *B01L 3/5027* (2013.01); *B01L 3/50851* (2013.01); *B01L 2200/027* (2013.01); *B01L 2200/0642* (2013.01); *B01L 2200/0684* (2013.01); *B01L 2200/0689* (2013.01); *B01L 2300/0819* (2013.01); *B01L 2300/0874* (2013.01); *B01L 2300/0887* (2013.01); *B01L 2300/0893* (2013.01); *B01L 2400/0406* (2013.01); *Y10T 29/49826* (2015.01); *Y10T 436/143333* (2015.01)

(58) Field of Classification Search
CPC ..... B01L 3/5027; B01L 2200/027; B01L 2300/874
USPC ..... 422/502, 503, 547, 551, 552, 553; 436/165, 180
See application file for complete search history.

(56) References Cited

U.S. PATENT DOCUMENTS

| | | | | |
|---|---|---|---|---|
| 6,083,761 | A * | 7/2000 | Kedar et al. | 506/30 |
| 6,485,690 | B1 * | 11/2002 | Pfost et al. | 422/552 |
| 6,585,939 | B1 * | 7/2003 | Dapprich | 422/503 |
| 2012/0184464 | A1 | 7/2012 | Lee et al. | |

OTHER PUBLICATIONS

Brouzes, Eric et al., Drolet microfluidic technology for single-cell high-throughput screening, PNAS, Aug. 25, 2009, vol. 106, No. 34, 14195-14200.
Hatch, A.C. et al., 1-Million Droplet Array for High-Dynamic -Range Digital Microfluidics, presented at the microTAS 2010, Groningen Netherlands, 2010 (3pages).
Hatch, A.C. et al., Tunable 3D droplet self-assembly for ultra-high-density digital micro-reactor arrays, Lab Chip, 2011, 11, 2509-2517.
(Continued)

*Primary Examiner* — Jill Warden
*Assistant Examiner* — Dwayne K Handy
(74) *Attorney, Agent, or Firm* — Vista IP Law Group LLP

(57) ABSTRACT

A multilayer well device includes a first substrate comprising an array of wells having a first pattern disposed therein and a second substrate comprising an array of wells having a second pattern, complementary to the first pattern disposed therein, wherein the second substrate is secured adjacent to a face of the first substrate. A common channel is interposed between the array of wells of the respective first and second substrates and is coupled to an inlet and an outlet.

15 Claims, 6 Drawing Sheets

(56) References Cited

OTHER PUBLICATIONS

Mark, Daniel et al., Microfluidic lab-on-a-chip platforms: requirements, characteristics and applications, Chem. Soc. Rev. 2010, 39, 1153-1182.

Pantano, Paul et al., Ordered Nanowell Arrays, Chem. Mater, 1996, 8, 2832-2835.

Sundberg, Scott O. et al., Spinning Disk Platform for Microfluidic Digital Polymerase Chain Reaction, Anal. Chem. 2010, 82, 1546-1550.

Whitesides, George M. et al., Soft Lithography in Biology and Biochemistry, Annu. Rev. Biomed, Eng. 2001,3:335-73.

* cited by examiner

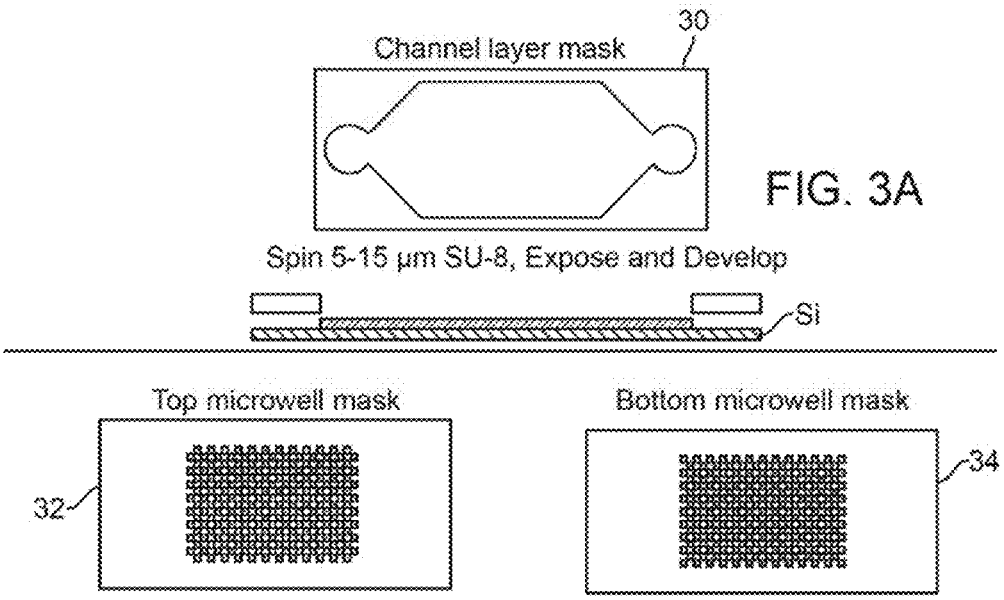
FIG. 3A
FIG. 3B
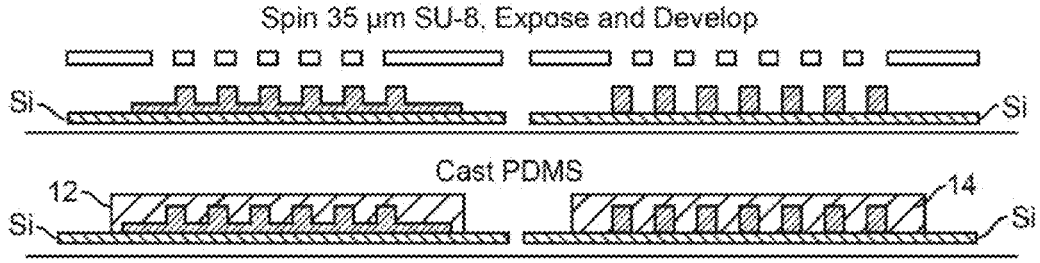
FIG. 3C
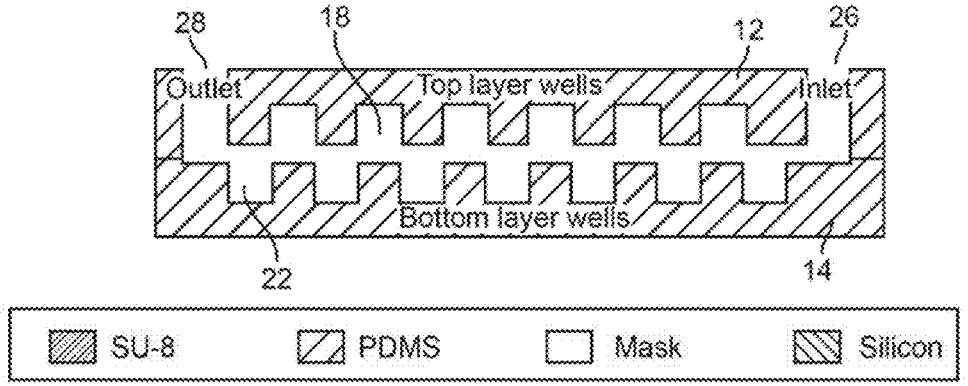
FIG. 3D

MULTILAYER HIGH DENSITY MICROWELLS

RELATED APPLICATION

This Application claims priority to U.S. Provisional Patent Application No. 61/525,976 filed on Aug. 22, 2011, which is hereby incorporated by reference in its entirety Priority is claimed pursuant to 35 U.S.C. §119.

STATEMENT REGARDING FEDERALLY SPONSORED RESEARCH OR DEVELOPMENT

This invention was made with Government support under Grant No. N66001-1-4003 awarded by the Defense Advanced Research Projects Agency (DARPA). The Government has certain rights in this invention.

FIELD OF THE INVENTION

The field of the invention generally relates to microwells and microarrays. More specifically, the field of the invention pertains to high density micro-reactors useful in digital biology applications.

BACKGROUND OF THE INVENTION

High density microwell plates or micro-reactors have been fabricated using various methods to form an array of sites or wells within a single surface. Although densities have become high, they are often limited by pattern formation and manufacturing techniques with often limited well height to width aspect ratios on only a single planar surface. As a result, a large usable area between the microwells is lost depending on the pitch or spacing between adjacent wells. As the footprint of the microwell size is reduced to accommodate even higher densities, the ratio of usable microwell area to dead space decreases exponentially resulting in even greater loss of usable area on the imaging plane for high density microwell reactors. The density loss due to well spacing must be minimized or eliminated to achieve higher densities.

In addition, limits in the manufacturability of high aspect ratio microwells makes it prohibitive to increase reactor densities beyond a certain value as it begins to adversely affect the possible reactor volumes or imaging resolution. Also, it is prohibitively difficult to fill each microwell reactor as the aspect ratio increases due to the dominant effects of surface tension at such small length scales. This prohibits fluid from reliably filling each reactor well completely.

More recently, attempts have been made to increase density and area coverage efficiency by using three-dimensional droplet emulsion arrays. For example, U.S. Patent Application Publication No. 2012-0184464 describes a system and method for the high density assembly and packing of microreactors. This method increases density and area coverage efficiency, however droplets are prone to movement over time, and require high surfactant concentrations to prevent droplet coalescence.

SUMMARY

In one embodiment, a multilayer high density well array is disclosed in which the density of microwell arrays is increased dramatically. The multilayer high density well array can be used for digital microfluidics to gain the advantage of immovable and well-defined microwell array patterns for real-time observation. Moreover, unlike droplet-based approaches, this eliminates the need for surfactants. Using this approach, as much as a two-fold increase in reactor array density can be achieved. In addition, improved image sensor area coverage efficiencies as high as 98% are possible with working focal depths of 70-100 μm's.

In another embodiment, a multilayer well device includes a first substrate comprising an array of wells having a first pattern disposed therein and a second substrate comprising an array of wells having a second pattern, complementary to the first pattern disposed therein, wherein the second substrate is secured adjacent to a face of the first substrate.

In yet another embodiment, a method of making a multilayer well device includes forming an array of wells having a first pattern disposed in a first substrate. An array of wells having a second pattern, complementary to the first pattern is formed in a second substrate. The face of the first substrate is secured to a face of the second substrate.

BRIEF DESCRIPTION OF THE DRAWINGS

FIGS. 3A-3D illustrate a method of making a multilayer well device according to one embodiment.

DETAILED DESCRIPTION OF THE ILLUSTRATED EMBODIMENTS

Figure 1A:
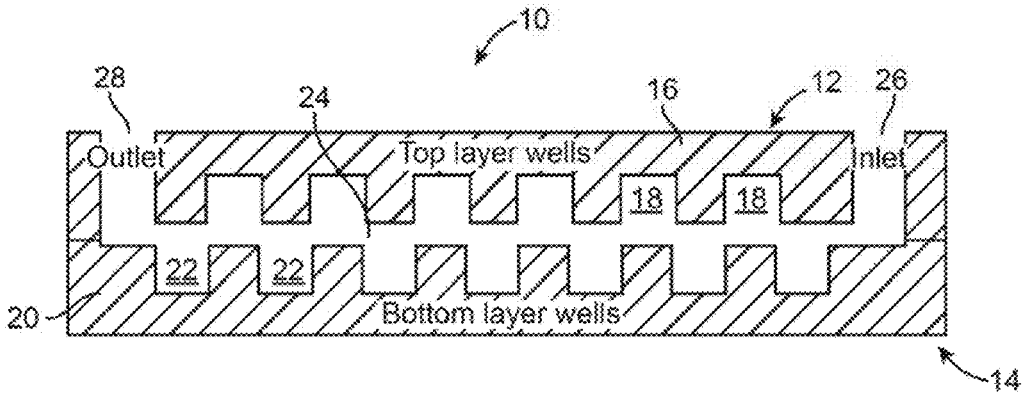
FIG. 1A illustrates a side view of a multilayer well device according to one embodiment.
Figure 1B:
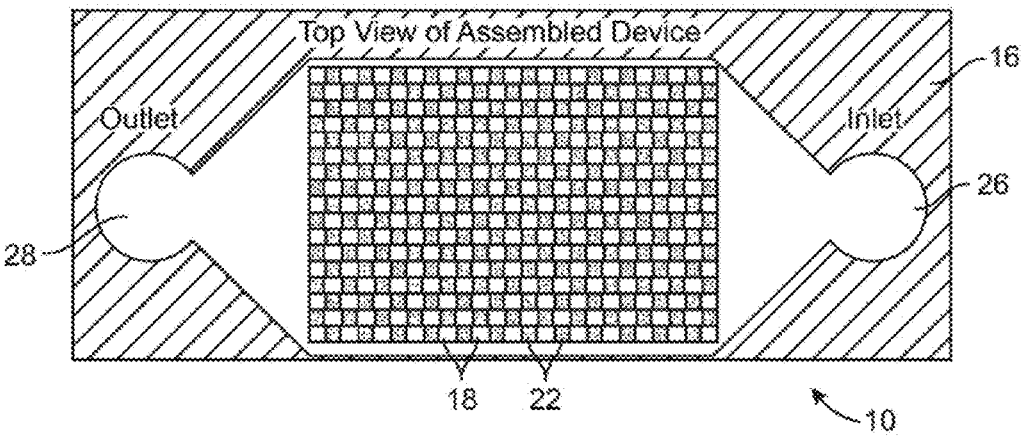
FIG. 1B is a top view of the multilayer well device of FIG. 1A.

FIGS. 1A and 1B illustrate side and top views, respectively, of a multilayer well device 10 according to one embodiment. The multilayer well device 10 is illustrated in FIGS. 1A and 1B as containing two (2) layers 12, 14. The upper layer 12 is formed from a first substrate 16 and contains therein an array of wells 18 having a first pattern. The first substrate 16 is preferably made from an optically transparent material which can include, as mentioned below, a polymer-based material. The lower layer 14 is formed from a second substrate 20 and contains therein an array of wells 22 having a second pattern that is complementary to the first pattern. As seen in FIG. 1A, the wells 22 of the second substrate 20 are laterally offset from the corresponding wells 18 of the first substrate 16. The second substrate 20 is also preferably made from an optically transparent material which can be the same as the material used for the first substrate 16.

The size of the wells 18, 22 may vary depending on the particular application or need. The wells 18, 22 may have micrometer or even millimeter sized dimensions. Typical well depths may fall within the range of about 5 μm to about 100 μm. Generally, the wells 18 of the first substrate 16 have similar dimensions to the wells 22 of the second substrate 20 although their respective orientations and patterns on their respective substrates are different.

Still referring to FIG. 1A, the first substrate 16 and the second substrate 20 are disposed in a facing arrangement so that the respective wells 18, 22 are facing each other. Preferably, the first substrate 16 and the second substrate 20 are secured to one another in a fixed manner. The first substrate 16 and second substrate 20 can be bonded to one another using direct bonding or some adhesive between the two layers. Alternatively, the first substrate 16 and the second substrate 20 can be mechanically held together using a clamp, fastener, or other mechanical means.

As seen in FIG. 1A, there is one or more common channels 24 interposed between the facing wells 18, 22. The common channel 24 preferably traverses the entire length of the respective array of wells 18, 22 and terminates at opposing ends at an inlet 26 and an outlet 28. The common channel 24 generally has a height within the range of about 1 μm to about 100 μm.

FIG. 1B illustrates a top view of the assembled multilayer well device 10. As seen in FIG. 1B, the wells 18 of the first substrate 16 are offset, though complementary, with respect to the wells 22 of the second substrate 20. For example, the wells 18, 22 both have square patterns in their respective substrates 16, 20 and when arranged in a facing manner, form a complementary array of facing wells.

Figure 2A:
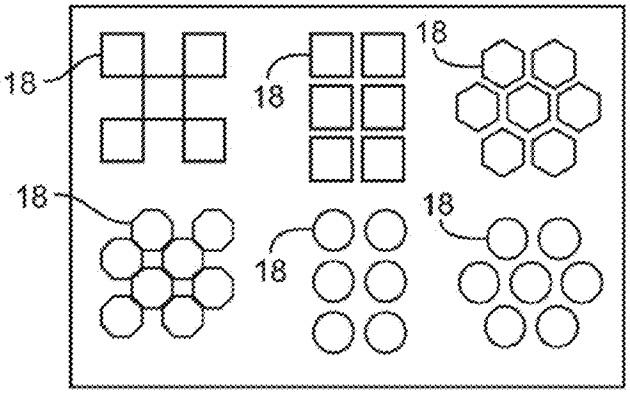
FIG. 2A illustrates a first pattern or "Pattern A" of wells that may be used in a first substrate as part of a multilayer well device.
Figure 2B:
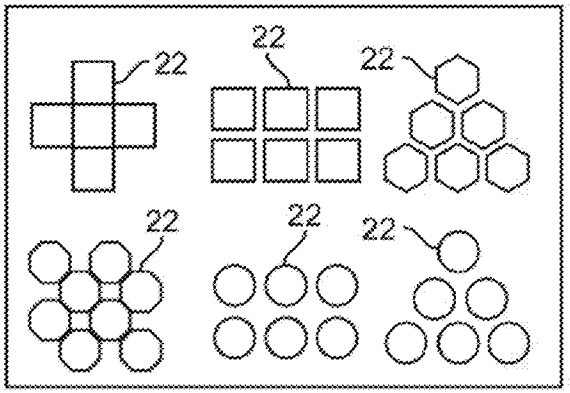
FIG. 2B illustrates a second pattern or "Pattern B" of wells that may be used in a second substrate as part of a multilayer well device.
Figure 2C:
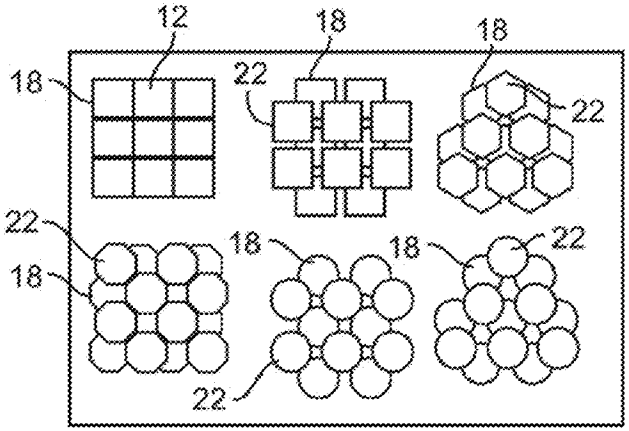
FIG. 2C illustrates the Pattern B wells of FIG. 2B being disposed atop the Pattern A wells of FIG. 2A.
Figure 2D:
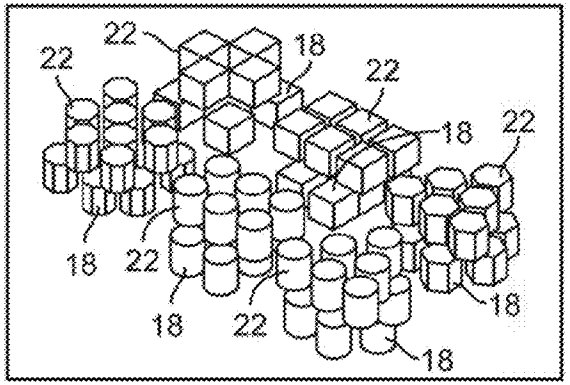
FIG. 2D is an isometric view of the multilayer of wells containing both the Pattern A and Pattern B wells in a facing arrangement.

FIG. 2A illustrates a number of different patterns of wells 18, 22 that may be used. FIG. 2A illustrates a first pattern or "Pattern A" of wells 18 that may be used in the first substrate 16. These include wells 18 in the shape of squares, hexagons, octagons, and circles. FIG. 2B illustrates a second pattern or "Pattern B" of wells 22 that may be used in the second substrate 20. These include wells 20 in the shape of squares, hexagons, octagons, and circles. When the complementary patterns are brought together as seen in FIG. 2C, when the first substrate 16 is brought in facing arrangement with the second substrate 20, the respective wells 18, 22 create pentagonal (left column), square (middle column), and hexagonal (right column) patterns. FIG. 2D illustrates an isometric view of the patterns formed by the wells 18, 22 when stacked on top of one another.

The multilayer well device 10 may be fabricated by forming an array of wells 18 having a first pattern in a first substrate 16. An array of wells 22 having a second pattern, complementary to the first pattern, is formed in a second substrate 20. The face of the first substrate 16 is then secured to the face of the second substrate 20 such that the respective array of wells 18, 22 face each other. FIGS. 3A-3D illustrate a method of making a multilayer well device 10 using Polydimethyl-Siloxane (PDMS) cast on SU-8 molds using standard soft lithography processes. A two-part mold is fabricated with one half of the mold containing a two-height SU-8 pattern with a 5-15 μm channel layer on the bottom followed by a 35 μm well layer disposed on top consisting of wells 18 having Pattern A. The second half of the mold is formed only with the 35 μm well layer disposed on top consisting of wells 22 having Pattern B. As seen in FIG. 3A, a channel mask layer 30 is used to spin 5-15 μm SU-8 atop a silicon base. The SU-8 is exposed and developed which is ultimately used to form the common channel 24. As seen in FIG. 3B, this silicon base having the SU-8 base layer is then spin coated with 35 μm SU-8 using a mask 32 that is patterned with wells 18 having the Pattern A configuration. The bottom layer is formed by spin coating 35 μm SU-8 using a mask 34 that is patterned with wells 22 having the Pattern B configuration. Next, as seen in FIG. 3C, PDMS is then cast over both mold halves to create the upper layer 12 and the lower layer 14. The cast PDMS halves 12, 14 are then plasma treated and aligned then bonded in a face-to-face arrangement as seen in FIG. 3D. The surface of one well 18 may be spritzed with ethanol to preserve the functionalization of the plasma treated surface while allowing a thin lubricating layer for 2-5 minutes to permit alignment of the two layers 12, 14 under microscopic view before actual bonding. Holes are punched to form the inlet 26 and the outlet 28. The PDMS halves 12, 14 may be aligned, optionally, using alignment posts (not shown) or the like.

While FIGS. 3A-3D illustrate a multilayer well device 10 formed using PDMS-based halves it should be understood that other optically transparent materials may be used. For example, wells 18, 22 may be formed in an optically transparent polymer or plastic material, or glass. The substrates 16, 20 may then be bonded to one another. In one aspect, optically transparent substrates 16, 20 may be bonded together using thin-film adhesives in a complementary fashion. Examples include double-sided hot-embossing techniques containing arrays open on opposite faces from each other but still in extremely close proximity to each other. These could be sealed with thermal, or pressure sensitive seals, or even immiscible fluids such as oils. In addition, while FIGS. 1A and 1B illustrate a multilayer well device 10 having two (2) layers, in other embodiments, the device 10 may have even more layers with subsequent layers stacked in complementary fashion.

Figure 4:
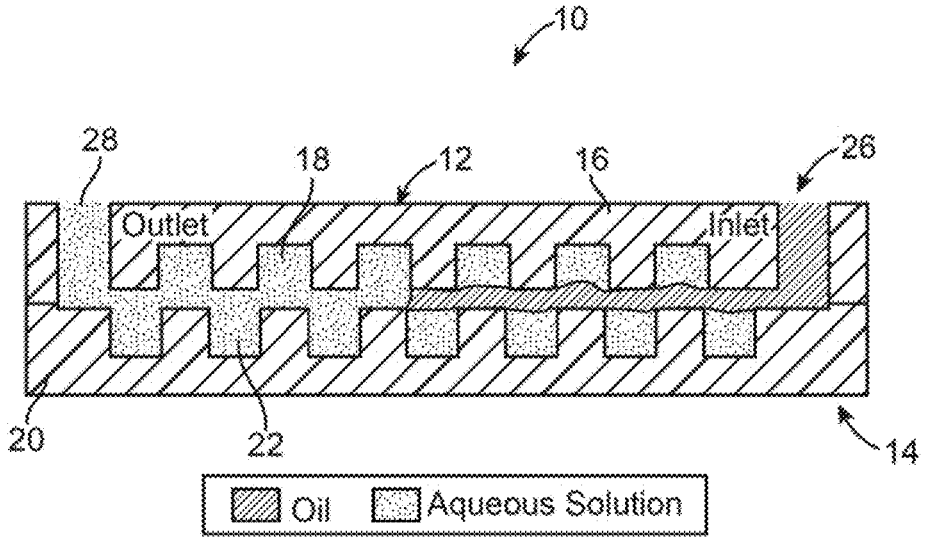
FIG. 4 illustrates filling of a multilayer well device.

In order to fill the multilayer well device 10, a first fluid is flowed into the inlet 26. The wells 18, 22 are still hydrophilic and, typically, this first fluid may include an aqueous fluid which contains the cells, organelles, or other biological constituents for imaging. In some embodiments, the first fluid also includes a fluorescent stain. The fluorescent stain may fluoresce when in the presence of a target species. For example, the fluorescent stain may be responsive to one or more molecules contained within first fluid. For example, the fluorescent stain may be used for performing biochemical or biological reactions or assays. For example, the device 10 can be used in Polymerase Chain Reaction (PCR) applications as well as used to quantify nucleic acid concentrations (e.g., DNA or RNA). In other embodiments, there is no need for a fluorescent stain if, for example, colorimetric changes occur within the wells 18, 22. Any air-bubbles or gas contained in the first fluid is allowed to outgas through the PDMS layer 12. Following filling the wells 18, 22 with the first fluid, an immiscible second fluid such as a light-mineral oil is injected behind the first fluid at a flow rate of around 1 μL/min to seal the first (aqueous) fluid inside each well 18, 22 leaving a thin 5-15 μm oil layer between them. The process of filling the multilayer well device 10 with the second, immiscible oil-based second fluid is seen in FIG. 4.

Figure 5:
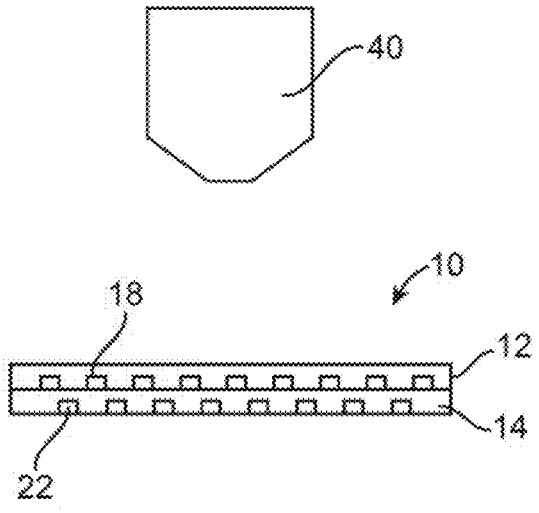
FIG. 5 illustrates an imager for imaging the multilayer well device.

FIG. 5 illustrates a multilayer well device 10 being imaged with an imaging device 40. The imaging device 40 may include a microscope or the like. The microscope can be a conventional microscope with a focal depth within the range of about 10 μm to 150 μm. There is no need for any complicated optical components such as a confocal imager. The multilayer well device 10 increases the microwell density per unit area in a two dimensional imaging plane by using a three-dimensional arrangement of wells 18, 22. The multilayer well device 10 increases the reactor density/area by using 100% of the imaging plane and increasing reactor density by as much as two-fold by allowing partial overlap of reactor wells 18, 22. Although reactor areas in underlying layers may partially overlap with those above, the patterning formations do not allow for 100% overlap of any single reactor with another, therefore image capture information from all wells 18, 22 can be individually resolved in the image.

For zero to low overlapping percentages less than 25%, a major region on the underlying well reactors 18, 22 are always visible, and the overlapping regions of various wells can be interpolated from each other based on specified pattern layouts and image processing techniques. The uppermost wells 18 closest to the imaging plane are always visible, however, information in those areas are still comprised from light transmission through them from the underlying reactor wells 22. This results because of the transparent nature of the well plate material, the microwell contents, and the oil phases which separate the two microwell layers allowing for the transmission of light through them resulting in little loss of information from the wells 22 in the bottom layer 14. The refractive indices of the microfluidic fluids and materials can be tuned to reduce lensing effects, both refractions, and reflections, to further reduce background noise levels and loss of light intensity reaching the imaging plane from the bottom reactor wells 22.

A key advantage of the multilayer well device 10 is the advantage gained by increasing the density of reactor wells per unit area on the imaging plane by as much as two-fold, thus allowing adequate image processing and resolution to distinguish intensity levels over all reactor wells. In addition, this method reduces the manufacturing process demands required to achieve high density reactor arrays. In addition, by using overlapping patterns, reactor density is increased without reducing the reactor volume or pixel coverage per unit reactor area. This permits one to capture higher density reactor arrays without high magnification imaging techniques to capture them simultaneously. Moreover, by keeping the separation distance between adjacent reactor planes small (less than 100 μm), the depth of focus required to adequately resolve both top and bottom microwell reactor planes simultaneously does not become prohibitively burdensome from an optical imaging perspective. Finally, unlike droplet based solutions, there is no need to have surfactants added to prevent droplet coalescence. Real time imaging is provided with predictable array patterns that remain motionless over time.

Figure 6A:
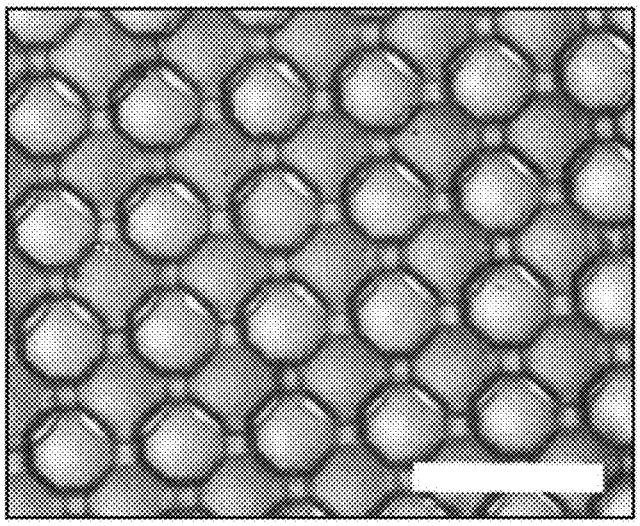
FIG. 6A illustrates a brightfield microscope image of a two-layer device having 40 μm deep, 70 μm diameter octagonal-shaped microwell arrays with a pitch of 90 μm and a layer separation of 15 μm fabricated in PDMS material.
Figure 6B:
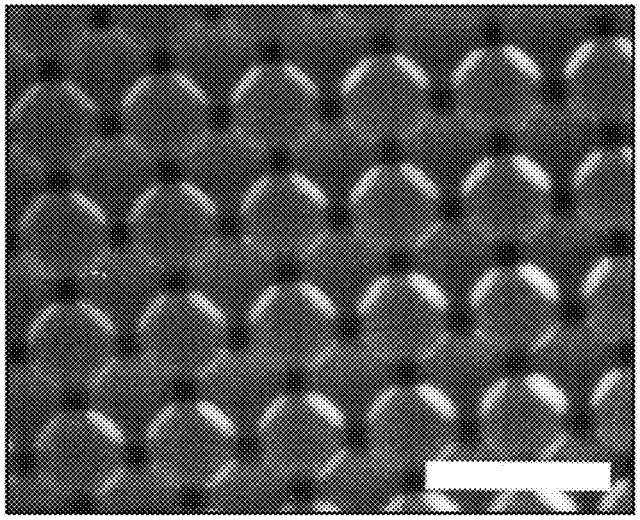
FIG. 6B illustrates fluorescent image of the same two-layer device of FIG. 6A.

FIG. 6A illustrates the brightfield microscope image of a two-layer device 10 having 40 μm deep, 70 μm diameter octagonal-shaped microwell arrays with a pitch of 90 μm and a layer separation of 15 μm fabricated in PDMS material. FIG. 6B illustrates fluorescent image of the same two-layer device 10. Microwells were filled with 1 μM fluorescein solution and sealed off with FC-40 fluorinert oil. Images were captured on an inverted microscope at 10× magnification using a 300 ms exposure and FITC filter set. Scale bars in FIGS. 6A and 6B are 150 μm in length. With respect to FIG. 6B, the overlap in the wells creates an additive fluorescent signal.

While embodiments of the present invention have been shown and described, various modifications may be made without departing from the scope of the present invention. For example, dimensions illustrated in the drawings are illustrative and may vary from those specifically mentioned therein. The invention, therefore, should not be limited, except to the following claims, and their equivalents.

What is claimed is:

1. A system comprising:

a multilayer well device comprising:

a first substrate comprising an array of wells having a first pattern disposed therein, the first pattern comprising wells of a first shape; and a second substrate comprising an array of wells having the first pattern and wells of the first shape disposed therein, wherein the second substrate is placed in contact with a face of the first substrate and forms a common channel interposed between the array of wells of the first substrate and the array of wells of the second substrate and wherein the array of wells in the first substrate is offset from the array of wells in the second substrate, wherein the wells in the first substrate partially overlap the wells in the second substrate and no well of the first substrate completely overlaps any well of the second substrate;

an inlet and an outlet formed in one of the first substrate and the second substrate, the inlet and outlet being in fluid communication with the common channel; and an imager disposed away from the first and second substrate and oriented to image the contents of the wells in the first substrate and the contents of the wells in the second substrate.

2. The system of claim 1, wherein the common channel has a height between about 1 μm and 100 μm.

3. The system of claim 1, wherein the common channel contains an immiscible fluid phase therein.

4. The system of claim 1, wherein the array of wells in the first substrate and the array of wells in the second substrate comprise square shapes.

5. The system of claim 1, wherein the array of wells in the first substrate and the array of wells in the second substrate comprise hexagonal shapes.

6. The system of claim 1, wherein the array of wells in the first substrate and the array of wells in the second substrate comprise octagonal shapes.

7. The system of claim 1, wherein the array of wells in the first substrate and the array of wells in the second substrate comprise circular shapes.

8. The system of claim 1, wherein the first substrate and the second substrate comprise PDMS.

9. A method of using the system of claim 1, comprising:

flowing an aqueous fluid into the inlet so as to fill the array of wells in the first substrate and the second substrate;

flowing an immiscible fluid into the inlet to fill the common channel; and imaging the multilayer well device with the imager.

10. The method of claim 9, wherein the aqueous fluid is flowed into the inlet with the device tilted upright.

11. A method of making a multilayer well device comprising:

forming an array of wells having a first pattern comprising wells of a first shape disposed in a first substrate;

forming an array of wells having the first pattern and wells of the first shape in a second substrate;

securing a face of the first substrate in contact with a face of the second substrate to form a common channel interposed between the array of wells of the first substrate and the array of wells of the second substrate, wherein the array of wells in the first substrate is offset from the array of wells in the second substrate, wherein the wells in the first substrate partially overlap the wells in the second substrate and no well of the first substrate completely overlaps any well of the second substrate; and forming an inlet and an outlet in one of the first substrate and the second substrate, wherein the inlet and outlet are in fluid communication with the common channel.

12. The method of claim 11, wherein the first substrate is aligned with respect to the second substrate via one or more alignment posts.

13. The method of claim 11, wherein the first and second substrates comprise PDMS.

14. The method of claim 11, wherein the first and second substrates comprise glass.

15. The method of claim 11, wherein the face of the first substrate is secured to the face of the second substrate with an adhesive.

* * * * *